United States Patent [19]

Ryan

[11] Patent Number: 4,949,739

[45] Date of Patent: Aug. 21, 1990

[54] WETSUIT WASHING HANGER DEVICE

[76] Inventor: Francis D. Ryan, 1770 Broadway Apt. #101, San Francisco, Calif. 94109

[21] Appl. No.: 306,169

[22] Filed: Mar. 13, 1989

[51] Int. Cl.[5] ..... B08S 3/02

[52] U.S. Cl. ..... 134/166 R; 134/115 R; 134/199; 134/201; 239/36; 239/425

[58] Field of Search ..... 134/166 R, 170, 198, 134/201, 115; 34/106; 223/85, 86, 92; 239/36, 435; 68/205 R

[56] References Cited

U.S. PATENT DOCUMENTS

| | | | |
|---|---|---|---|
| 2,303,313 | 12/1942 | Abbens | 223/86 |
| 2,461,149 | 2/1949 | Ericson | 223/86 |
| 4,592,497 | 6/1986 | Georges | 223/85 |
| 4,653,295 | 3/1987 | Clifford | 68/205 R |

FOREIGN PATENT DOCUMENTS

| | | | |
|---|---|---|---|
| 1261277 | 4/1961 | France | 223/86 |

*Primary Examiner*—Frankie L. Stinson
*Attorney, Agent, or Firm*—John J. Leavitt

[57] ABSTRACT

A wetsuit washing hanger includes a pair of hollow laterally extending arms for supporting a wetsuit by its shoulder area. The hollow interior of the arms communicate with an integral funnel into which water from a shower head from which the device is suspended may be directed. Apertures in the side walls of the hollow arms enable a washing liquid to spray onto the interior of the wetsuit.

8 Claims, 2 Drawing Sheets

WETSUIT WASHING HANGER DEVICE

This is the addition of the claim to application Ser. No. 07/306,169 filed 6th Feb. 1989.

BACKGROUND OF THE INVENTION

A wetsuit washing hanger device is needed so as to allow a wetsuit to be washed and rinsed free of salt, perspiration and other deposits after use to maximise the usefull life of the wetsuit and minimise the irritation caused by residual deposits to the user. Thereafter the wetsuit may be left to dry or stored on said wetsuit washing hanger.

SUMMARY OF THE INVENTION

A wetsuit washing hanger device to supply water or other washing liquid internally to a wetsuit while the wetsuit is hanging. The basis for operation is the ability to feed water from an ordinary shower head into a capture funnel which then flows into the body of the hollow plastic hanger where it can then exit through small holes which are placed along the length of the hollow arms of said hollow plastic hanger hence spraying the inside of the wetsuit with said washing liquid.

DESCRIPTION OF THE DRAWING (a) A hollow plastic hanger with a funnel to allow the free flow of washing liquid. The connection of said funnel to said hollow arms being designed such as to allow maximum flow of washing liquid. A series of small holes are placed along the length of the hollow arms.

(b) A hook which attaches to the funnel which allows the wetsuit washing hanger to hang from any ordinary shower head. The diameter of said hook will be such as to allow a secure connection to said shower head.

(c) A wetsuit is shown with the device in operation.

(d) A shower head is shown with the device in operation.

DESCRIPTION OF THE PREFERRED EMBODIMENT

Figure 1:
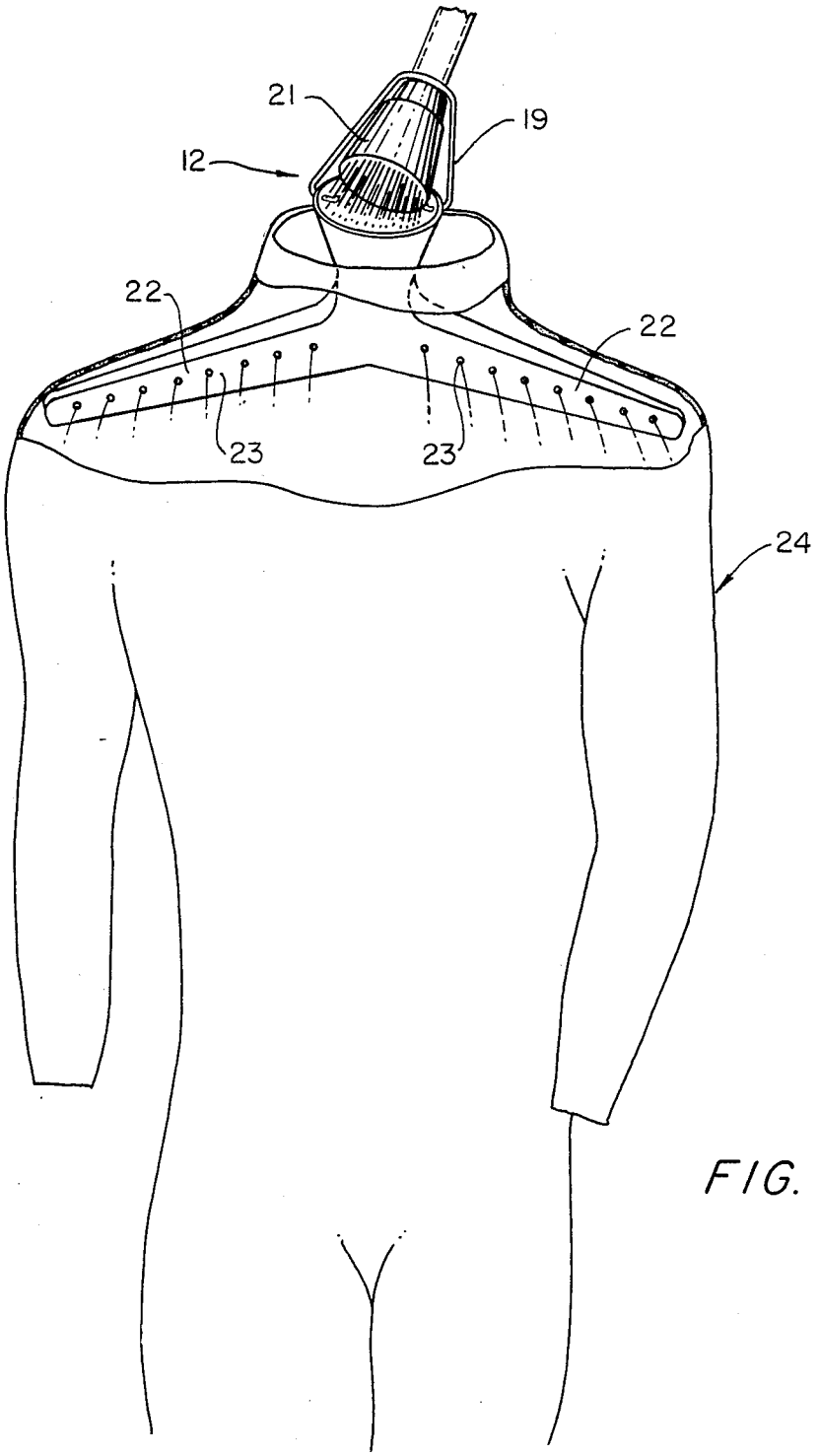
Figure 2:
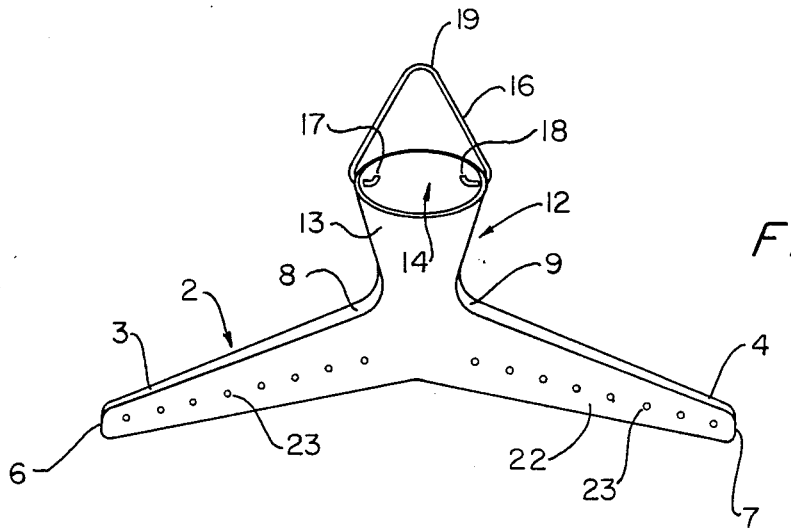
Figure 3:
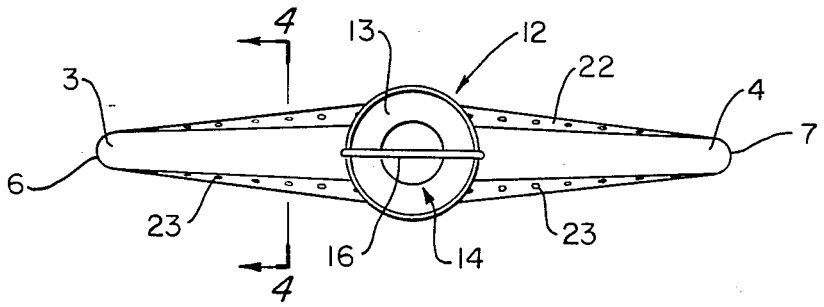
Figure 4:
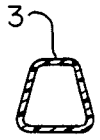
Figure 5:
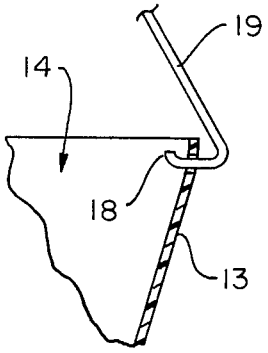

The wetsuit washing hanger of this invention is referred to generally in FIG. 1.

A hollow plastic hanger with a funnel head formed to be free of all sharp edges. The diameter of the head of said funnel being such as to allow the maximum flow of water from shower head to the hollow arms of the hanger. A series of small holes are placed along the length of the hollow arms. The design of the arms and funnel portion of the wetsuit washer is such as to be smooth and generally continuos to ensure no damage may be occur to the wetsuit while it is hanging on the wetsuit washing hanger as indicated in the attached drawing (FIG. 1(*a*)).

A hook which attaches to the funnell with sufficient freedom of motion so as to allow for use over a variety of shower head sizes as indicated in the attached drawing (FIG. 1(*b*)). The attachment of the hook to the funnel is also such as to place the connection facing inward toward the inside of the funnell so as to present at all times a smooth surface to the wetsuit.

I claim:

1. In combination, (a) a wetsuit of the type that is formed from material that is impervious to the passage of water therethrough;

(b) a shower head connected to a source of water that may be selectively turned on to discharge water through said shower head; and (c) a hollow hanger device for suspending the wetsuit from said shower head so that when water is discharged from said shower head the water is directed through said hollow hanger device to all parts of the interior of said wetsuit to thereby wash the interior thereof.

2. The combination according to claim 1, in which said hanger device comprises a pair of lateral oppositely extending hollow arms each having at least two series of spaced apertures therein through which water is sprayed onto the interior of the wetsuit, said hollow arms being closed at their free ends.

3. The combination according to claim 1, in which said hanger device includes a conical funnel portion having an apex end and an open mouth end, a pair of lateral oppositely extending hollow arms closed at their outer ends and integral with said funnel portion at their inner ends, the interior of said hollow arms communicating with the interior of said funnel member at the apex end thereof, a bale attached to the mouth end of said conical funnel portion and detachably engaging said shower head so that the open mouth end of said funnel portion is suspended under said shower head so that water discharged from said shower head flows into said hollow hanger device, and apertures in said hollow arms for distributing the water that flows through said hanger device onto the interior surface of said wetsuit.

4. The combination according to claim 1, in which said hanger device is formed from a synthetic resinous material.

5. As an article of manufacture, a wetsuit washing hanger device for suspending a wetsuit under a shower head for the purpose of discharging water into the wetsuit to wash or rinse the interior thereof, comprising:

(a) a hollow body including a funnel portion having an open mouth end for receiving water from said shower head and a smaller diameter apex end for delivering water from said funnel portion;

(b) a pair of lateral oppositely extending hollow arms forming a part of said hollow body and integral with said funnel portion at said apex end thereof and closed at their ends remote from said funnel portion, the interior of said hollow arms communicating with the interior of said funnel portion so that water discharged into said funnel portion is directed into. said lateral oppositely extending arms;

(c) a bale mounted on said funnel portion and selectively manipulable to detachably suspend the hanger device from an associated shower head; and (d) apertures in said lateral oppositely extending hollow arms through which water directed into said hollow body may be discharged for the purpose of washing or rinsing the interior of a wetsuit suspended on said hanger device.

6. The hanger device according to claim 5, in which each said hollow arm is provided with at least two series of spaced apertures, each series extending along opposite lateral sides of the arm.

7. The hanger device according to claim 5, in which said hollow body is formed from a synthetic resinous material.

8. The hanger device according to claim 5, in which said bale is generally triangular in configuration with opposite ends of the bale engaging diametrically opposed peripheral portions of said funnel portion adjacent the open mouth thereof.

* * * * *